US006332824B2

(12) United States Patent
Tell et al.

(10) Patent No.: US 6,332,824 B2
(45) **Date of Patent: *Dec. 25, 2001**

(54) CONVERTIBLE CHILD'S TOY

(76) Inventors: Robert A. Tell, 6534 Ward Rd.; David B. Fisher, 6791 E. Quaker St., both of Orchard Park, NY (US) 14127; Domenic T. Gubitosi, 201 Kelly Dr., East Aurora, NY (US) 14052; Christopher D. Cimerman, 66 S. Bellevue Ave., Depew, NY (US) 14043

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 11 days.

(21) Appl. No.: 09/449,477

(22) Filed: Nov. 29, 1999

(51) Int. Cl.[7] ..... A63H 33/00

(52) U.S. Cl. ..... 446/227; 446/71; 446/143; 446/408

(58) Field of Search ..... 446/227, 143, 446/408, 71, 81, 485

(56) References Cited

U.S. PATENT DOCUMENTS

| | | | | |
|---|---|---|---|---|
| D. 339,173 | | 9/1993 | Marschak | D21/59 |
| 2,788,608 | * | 4/1957 | Anthony | 446/143 |
| 4,904,220 | | 2/1990 | Williams et al. | 446/227 |
| 4,923,428 | * | 5/1990 | Curran | 446/299 |
| 5,145,447 | * | 9/1992 | Goldfarb | 446/408 |
| 5,454,745 | * | 10/1995 | Spielberger | 446/227 |
| 5,478,268 | | 12/1995 | Au | 446/227 |
| 5,788,253 | | 8/1998 | Thomson et al. | 280/87.041 |
| 6,203,395 | | 3/2001 | McElhaney . | |

* cited by examiner

*Primary Examiner*—D. Neal Muir
*Assistant Examiner*—Urszula M. Cegiellnik
(74) *Attorney, Agent, or Firm*—Morgan, Lewis & Bockius, LLP

(57) ABSTRACT

A child's toy is provided which is convertible between an infant's gym and a toddler's piano. In the infant configuration, a small child can be placed under or seated in front of the toy within reach of hanging shapes. When the infant moves the hanging shapes, a sensory output of music and lights is produced through audio speakers and lighted keys. The infant's gym can be converted into a toddler configuration, which has keys arranged on top, resembling a piano. A toddler standing in front of the piano can produce a sensory output of music and lights by pressing the keys. A mode switch can be adjusted to vary the duration of the sensory output.

17 Claims, 9 Drawing Sheets

CONVERTIBLE CHILD'S TOY

BACKGROUND OF THE INVENTION

1. Field of the Invention

The present invention relates to a child's toy that produces a musical output and a light display in response to activation by the child. More particularly, the invention is directed to a toy that can be converted from an infant's gym to a piano suitable for toddlers.

2. Background of the Invention

Children at different stages of development have widely varying physical capabilities and mental aptitudes. In order to entertain and stimulate children at different developmental stages, many different toys are needed, leading to increased expense and clutter. It is desired to provide a toy that is usable by a child over a range of years, and that continues to stimulate the child as he or she develops. Activity gyms have proven useful in this regard because they present different activities on a single toy that are tailored to different age groups. Many activity gyms also accommodate children of different height by allowing their display angle to be varied. However, known activity gyms have failed to provide activities of interest to children over a wide range of ages. A toy is needed that can entertain children of different ages with differing levels of physical and mental development.

SUMMARY OF THE INVENTION

The present invention provides a child's toy which is convertible between an infant's gym and a toddler's piano. In the infant configuration, a small child can be placed under or seated in front of the toy within reach of hanging shapes. When the infant moves the hanging shapes, a sensory output of music and lights is produced. The infant's gym can be converted into a toddler configuration, which has keys arranged on top, resembling a piano. A toddler standing in front of the piano can produce a sensory output of music and lights by pressing the keys. Therefore, the present invention provides a toy which stimulates and entertains children over a range of ages, sizes, and interests.

In a preferred embodiment, the toy has a substantially planar activity unit mounted on two supports. The activity unit has audio speakers and lighted keys to provide a sensory output when activated. Further, the activity unit and supports have interlocking elements which allow the activity unit to be moved between a vertical orientation and a horizontal orientation, corresponding to the infant's gym and toddler's piano, respectively. In the infant configuration, several shapes are suspended from the lower edge of the activity unit. Movement of the shapes initiates a sensory output of music and lights. In the toddler configuration, a sensory output is produced by pressing the keys on the activity unit. The sensory output is controlled by an output control unit located in the activity unit. A mode switch on the activity unit can be adjusted to vary the duration of the sensory output.

Numerous other objects and features of the invention should become apparent upon a reading of the following detailed description taken in conjunction with the accompanying drawings.

BRIEF DESCRIPTION OF THE DRAWINGS

The accompanying drawings, which are incorporated in and constitute a part of this specification, illustrate embodiments of the invention and together with the description, serve to explain the principles of the invention.

DESCRIPTION OF THE PREFERRED EMBODIMENT

Figure 1:
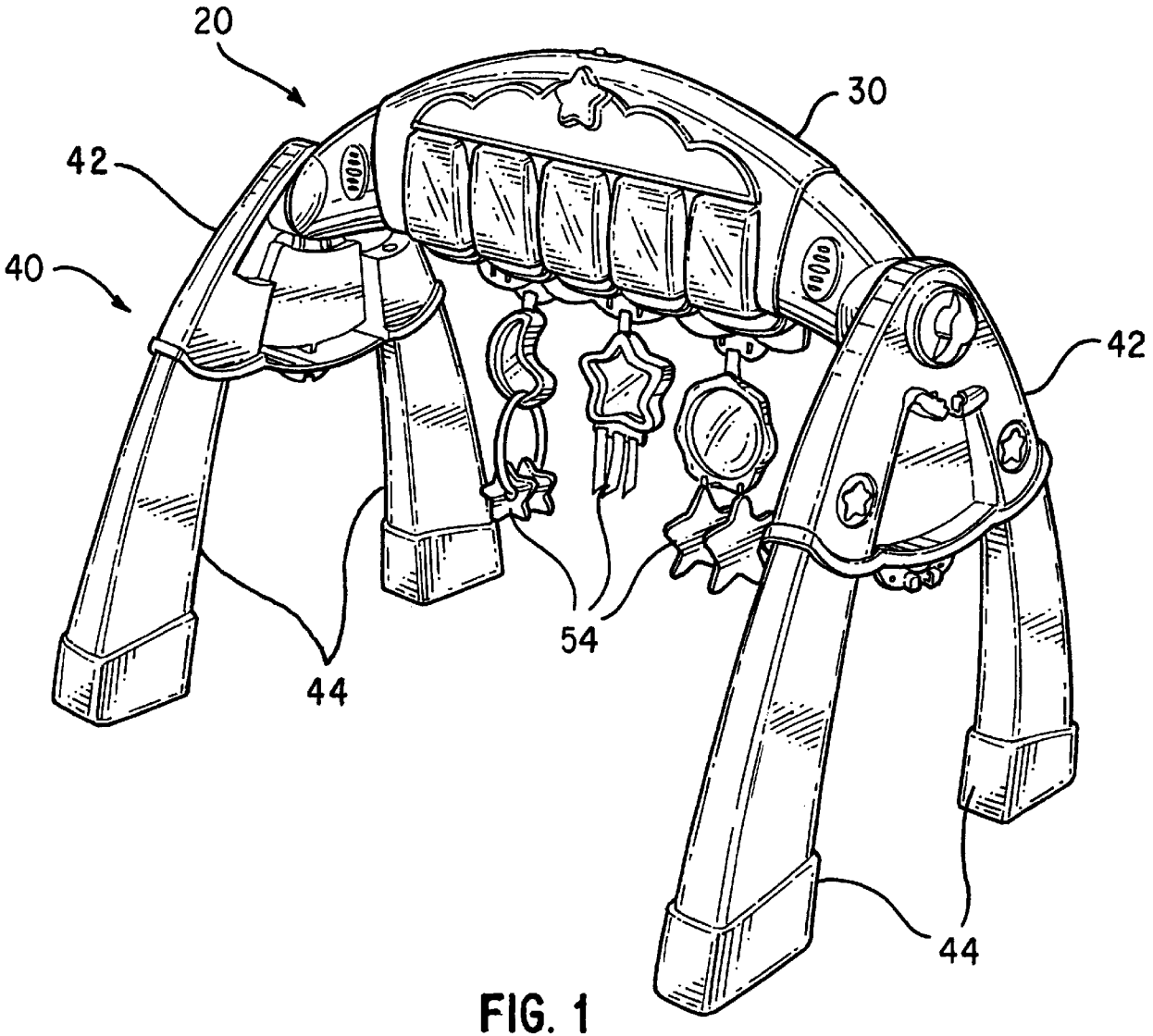
FIG. 1 is a perspective view of the toy in the infant configuration.
Figure 2:
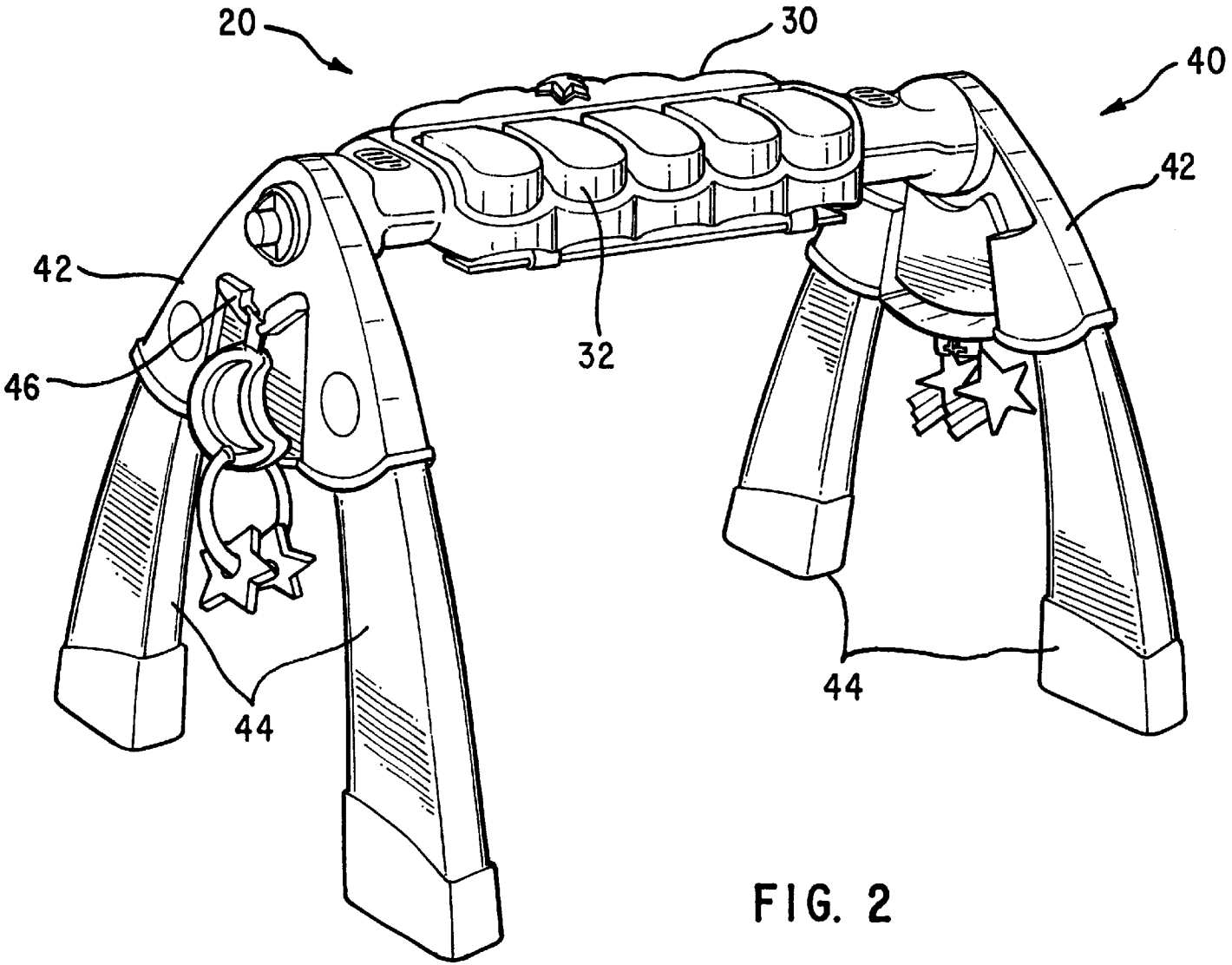
FIG. 2 is a perspective view of the toy in the toddler configuration.
Figure 4:
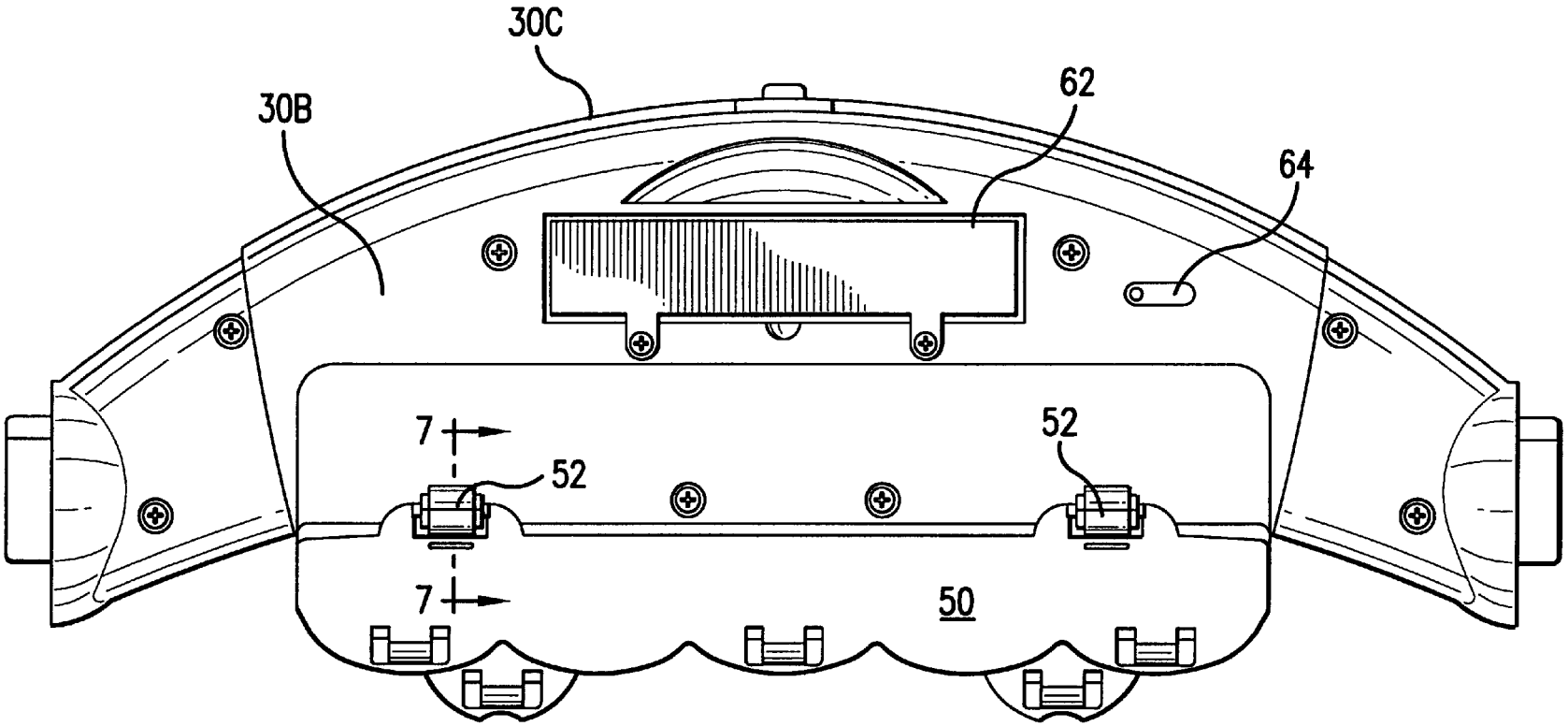
FIG. 4 is a rear view of the activity unit with the rocker bar deployed.
Figure 5:
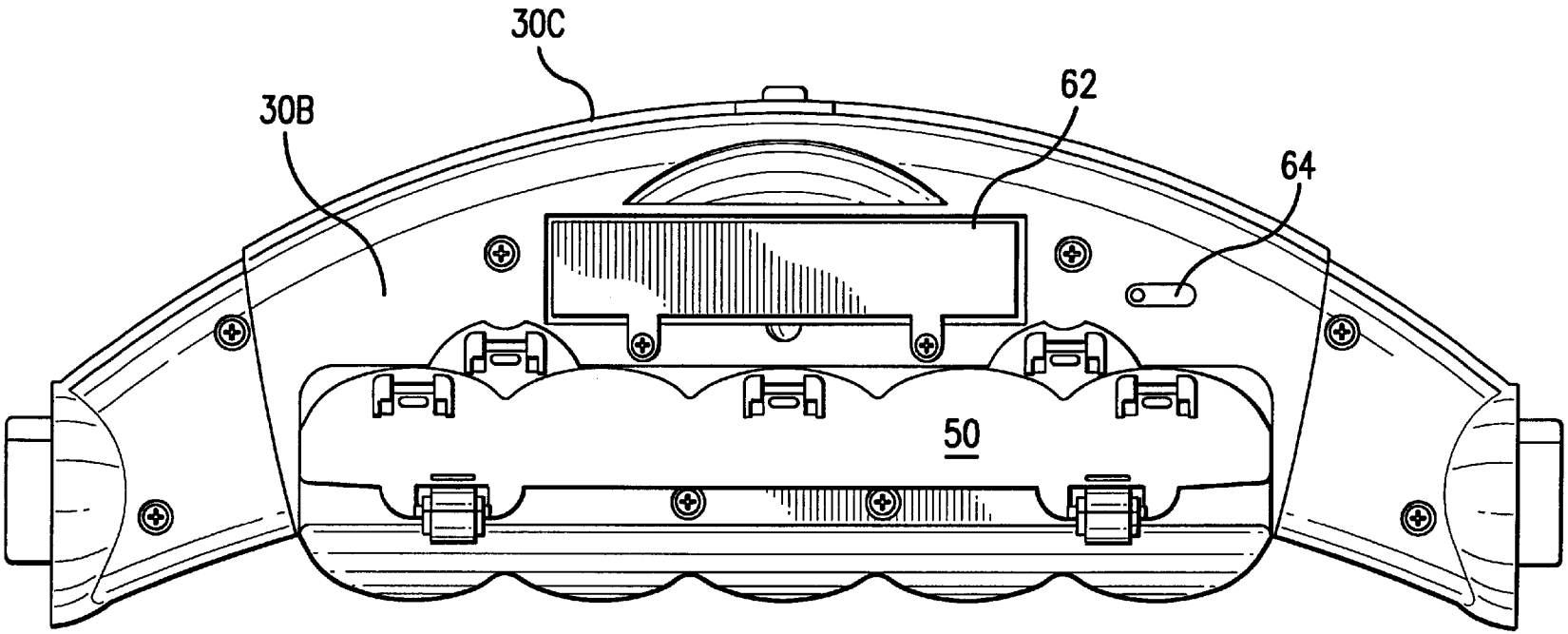
FIG. 5 is a rear view of the activity unit with the rocker bar stowed.

A convertible toy 20 embodying the principles of the invention is illustrated in FIGS. 1 and 2. As shown, the toy 20 comprises an activity unit 30 supported on a base 40. The base 40 has two support members 42, each having a pair of legs 44. The activity unit 30, shown in FIGS. 3–5, has an elongated shape with generally parallel front and back faces 30A,30B and a rounded top 30C.

Figure 3:
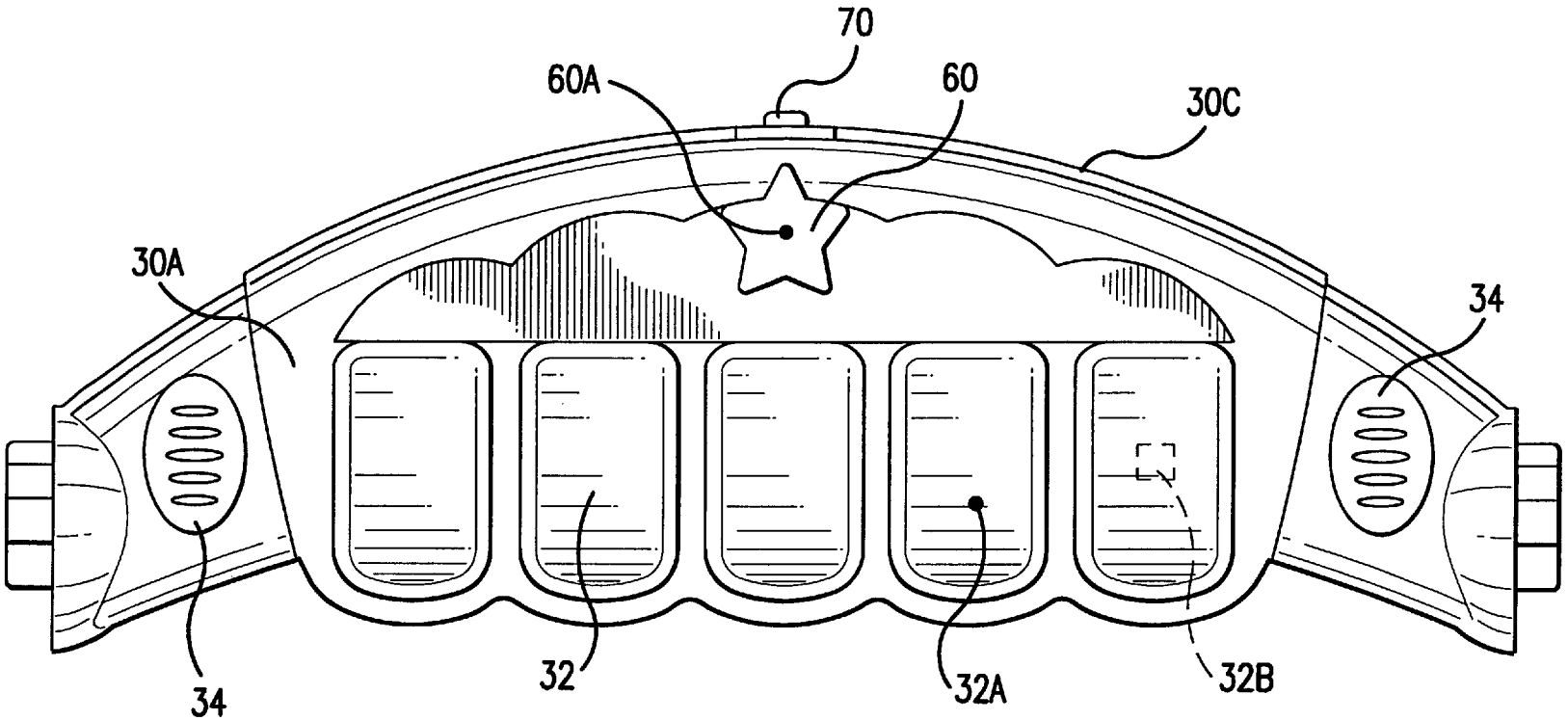
FIG. 3 is a front view of the activity unit.

Colored keys 32 are arranged across the front face 30A of the activity unit 30, as shown in FIG. 3. The keys 32 are transparent or opaque colored plastic and have a light bulb 32A mounted inside. Audio speakers 34 are arranged on the front face 30A at each end of the keys 32. The keys 32 and speakers 34 provide the sensory output of the toy 20. The keys 32 light up to provide a visual output and the speakers 34 play music to provide an audio output when the toy 20 is activated.

Figure 6:
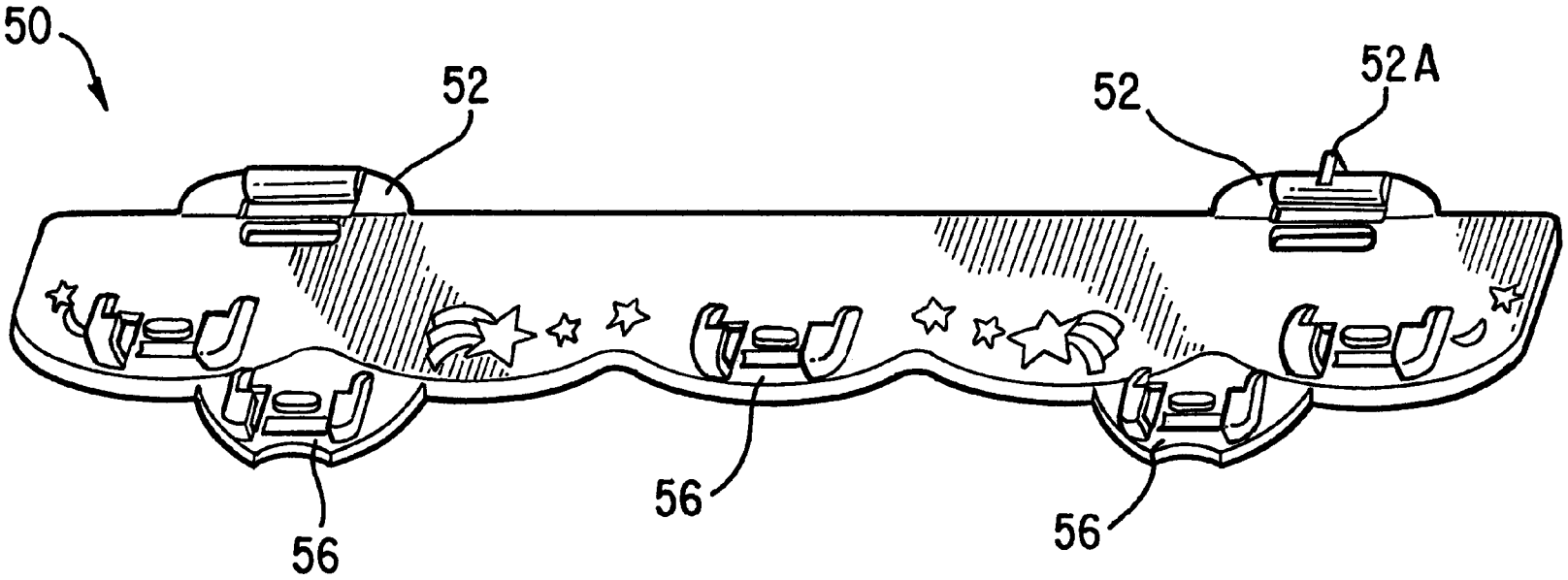
FIG. 6 is a perspective view of the rocker bar.
Figure 7:
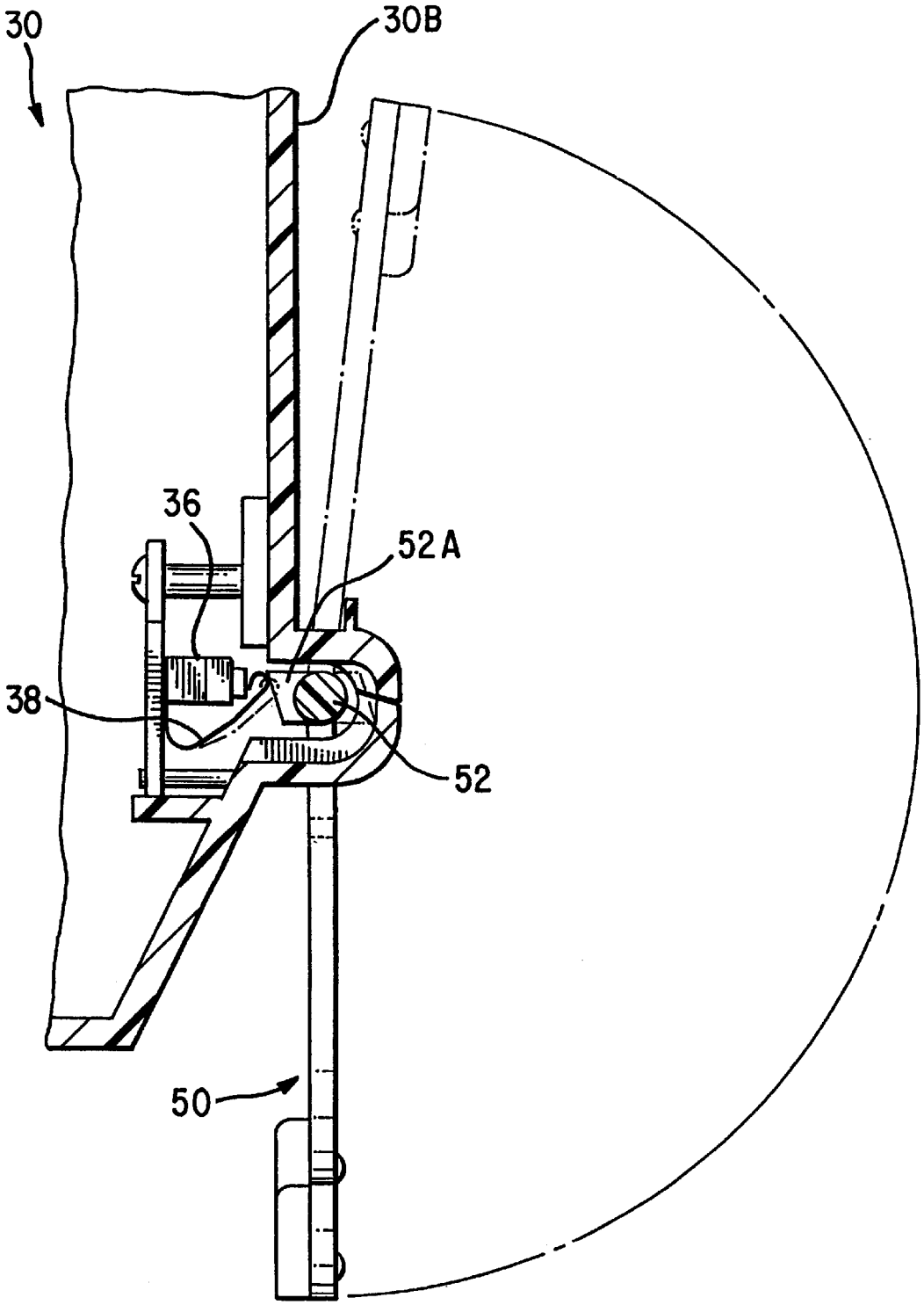
FIG. 7 is a view taken along line 7—7 in FIG. 4.

The toy 20 is activated or actuated by pressing one of several switches. A rocker switch 36, shown in FIG. 7, mounted inside the rear face 30B of the activity unit 30, is activated or actuated, through motion of a rocker bar 50. The rocker bar 50 is shown on the activity unit 30 in FIG. 4, and in a perspective view in FIG. 6. The rocker bar 50 is rotatably mounted on the rear face 30B of the activity unit 30 with two hinges 52. One of the hinges 52 has an integral cam surface 52A which interacts with a leaf spring 38 to depress the rocker switch 36, shown in FIG. 7. The rocker bar 50 can be moved between a deployed position, shown in FIG. 4, and a stowed position, shown in FIG. 5. In the deployed position, toys can be suspended from hooks 56 along the lower edge of the rocker bar 50, shown in FIG. 6. When the rocker bar 50 is moved to the stowed position, the cam 52A rotates out of engagement with the leaf spring 38, and activation or actuation of the rocker switch 36 is prevented.

A key switch 32B, shown in FIG. 3, may also be used to activate or actuated the toy 20. A key switch 32B is mounted beneath each key 32 on the front face 30A of the activity unit 30. Pressing on a key 32 causes the key 32 to contact and depress the key switch 32B.

Lastly, a sound effects switch 60A, shown in FIG. 3, is mounted on the front face 30A of the activity unit 30 beneath the sound effects button 60. Pressing on the sound effects button 60 will depress the sound effects switch 60A.

Figure 9:
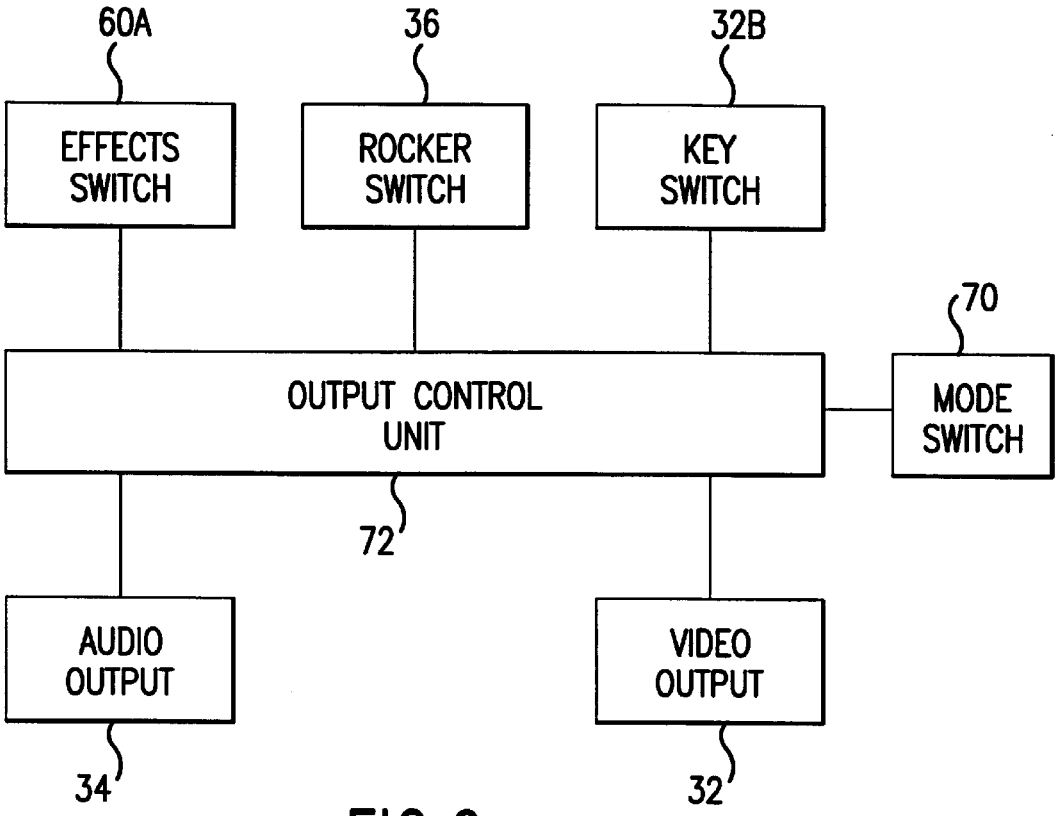
FIG. 9 is a schematic of the circuit of the present invention.

The activation of the toy 20 to produce a sensory output is controlled by an electronic control circuit. In a preferred embodiment, power is supplied by batteries stored in a battery compartment 62 on the back 30B of the activity unit 30, shown in FIG. 4. A schematic of the control circuit is shown in FIG. 9. As shown, an output control unit 72 receives an input signal from one of the switches and, in response, sends a signal to the output devices 32,34 to produce the proper sensory output. An output mode of the output control unit 72 is set using a mode switch 70 located on top 30C of the activity unit 30, shown in FIG. 3. The mode switch 70 has three settings: off, short play, and long play. For a given output mode, the sensory output varies depending on whether the rocker bar 50 or a key 32 is used to initiate the output. The volume of the audio output can be adjusted between a high and a low setting with a slider switch 64 on the rear face 30B of the activity unit 30. The preferred embodiments the operation of the output control unit 72 will be described with reference to each configuration of the toy 20.

Figure 8:
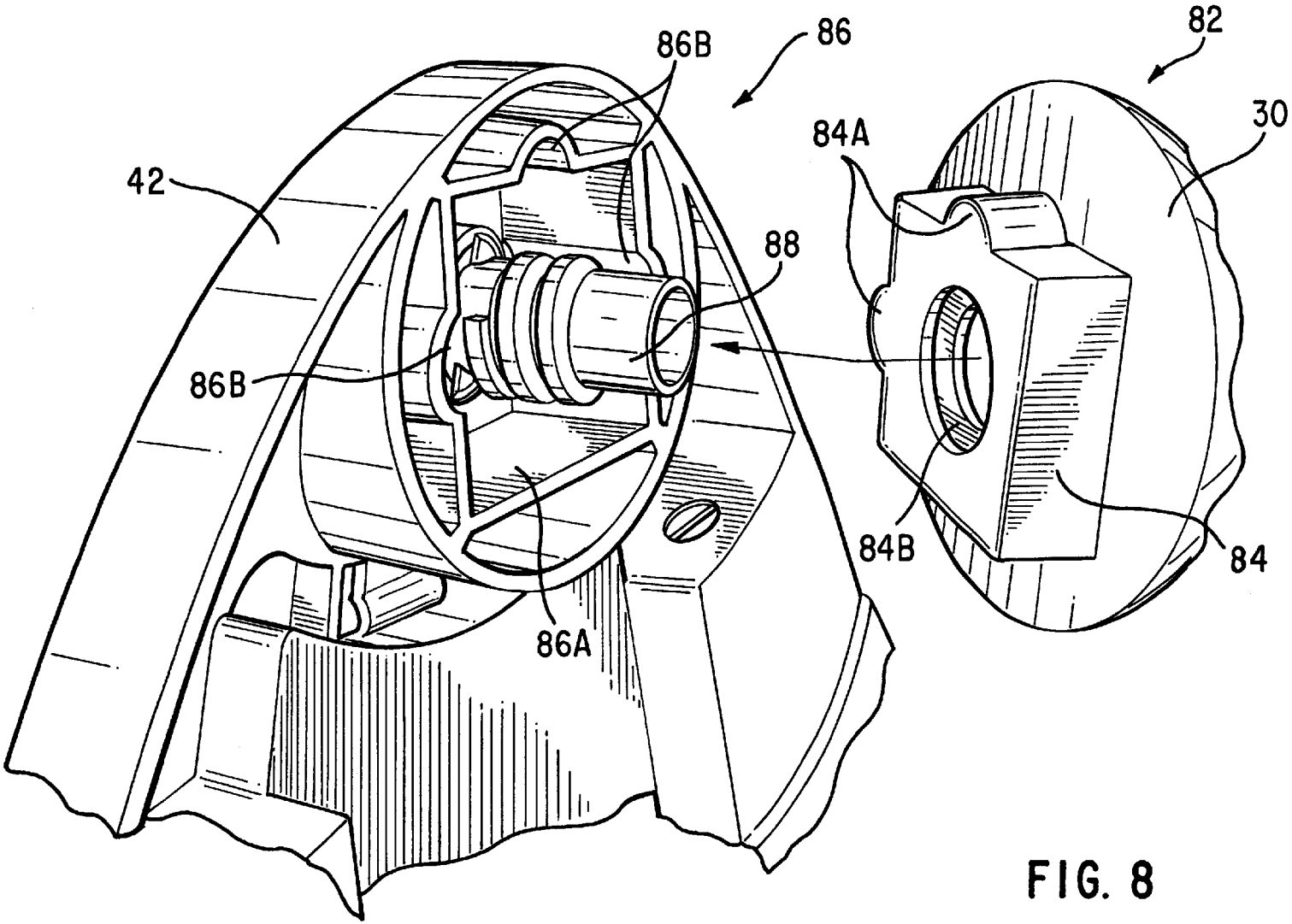
FIG. 8 is a detailed view of the interlocking elements of the activity unit and base.

The activity unit 30 may be positioned on the support members 42 in a vertical orientation and a horizontal orientation, corresponding to an infant configuration and a toddler configuration, respectively. The activity unit 30 is secured in a given orientation through the engagement of interlocking elements 82,86 on the activity unit 30 and the support members 42. A detailed view of the interlocking elements 82,86 is shown in FIG. 8. First interlocking elements 82 are arranged at each end of the activity unit 30. The first interlocking elements 82 have a four-sided hub 84. Two adjacent sides of the hub 84 have a projection 84A on an outer surface. The hub 84 also has a threaded opening 84B in the center. Second interlocking elements 86 are arranged on an upper portion of the support members 42. The second interlocking elements 86 have a housing with a four-sided recess 86A for receiving the hub 84. Three sides of the recess 86A are formed with an indentation 86B for receiving a hub projection 84A. This arrangement of indentations 86B allows the recess 86A to receive the hub 84 in two different orientations. A captive screw 88 in the support member 42 is threaded into the opening 84B to draw the interlocking elements 82,86 together and hold them in locked engagement.

In the infant configuration, the activity unit 30 is oriented vertically and several shapes 54 are suspended from the rocker bar, as shown in FIG. 1. The toy 20 in this configuration can be used to entertain an infant lying underneath or a small child sitting in front of the toy. Although the keys 32 are active, the preferred way of producing a sensory output is by moving the hanging shapes 54. The shapes 54 can be moved by a parent or by a child sitting in front of the toy. When the shapes 54 are moved, the rocker bar 50 is caused to pivot, which causes the cam 52A to press on the leaf spring 38, which in turn activates the rocker switch 36. When the mode switch 70 is set on short play mode and the rocker switch 36 is activated, one song will play. While the song is playing, the keys 32 will light up in a random pattern. There are a number of songs stored in the control unit memory, each song having a unique light display associated with it. If the rocker switch 36 is activated additional times, the control unit 72 will cycle through the songs stored in memory, each time playing the next song and displaying its associated light pattern. In the long play mode, activation of the rocker switch 36 will result in ten minutes of continuous music. During the musical output, the control unit 72 will play the stored songs sequentially, and during each song, display the light pattern associated with the song that is playing.

Several steps are required to convert the toy 20 to the toddler configuration. First the hanging shapes 54 are removed from the rocker bar 50 and are placed on hooks 46 on the support members 42, shown in FIG. 2. Next, the rocker bar 50 is pivoted to the stowed position, taking the cam 52A out of contact with the leaf spring 38. The rocker bar is shown in the stowed position in FIG. 5, and in FIG. 7 in broken lines. With the rocker bar 50 in the stowed position, the rocker switch 36 is effectively disabled. Next, the screws 88 are loosened, allowing the interlocking elements 82,86 to come out of engagement. The activity unit 30 is then rotated into a horizontal orientation. The interlocking elements 82,86 are engaged, and finally, the screws 88 are tightened to lock the activity unit 30 in position.

The toy 20 is shown in the toddler configuration in FIG. 2. As shown, the activity unit 30 is oriented horizontally with keys 32 arranged on an upper surface. In the toddler configuration, the toy 20 can be used to entertain small children standing in front of the toy 20 and playing it, similar to a piano. Here, pressing the keys 32 is the preferred way of producing a sensory output. When a key 32 is pressed, the key switch 32B beneath the key 32 is activated and an output is produced. In both the short play and long play output modes, a key 32 will light up when it is pressed. In the short play mode, when a key 32 is pressed, a single tone is produced. In the long play mode, when a key 32 is pressed, a segment of a song is played. If any key 32 is subsequently pressed, the next segment of the song will be played. The child user is therefore able to "compose" pieces of music using either discrete tones or segments of songs.

The effects button 60, located above the keys 32 on the activity unit 30, is active in both the infant and toddler configurations. The effects button 60 produces an audio output independently of the output mode setting. Pressing the effects button 60 will produce an audio output comprising one of several stored sound effects. If the effects button 60 is repeatedly pressed, the stored sound effects will be played sequentially.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A convertible toy for use by a toddler and an infant, said convertible toy having a first and second configuration and being supportable on a support surface, comprising:

an activity unit including a housing defining a substantially planar surface, and a sensory output device, said sensory output device including a first switch for selecting between an "on" and "off", at least one second switch for producing audio output by the toddler, a third switch for producing audio output by the infant, said third switch being associated with a support for at least one dangling toy, said third switch being disabled when said support is in a non-use position, and a microprocessor associated with said first switch, said at least one second switch and said third switch, said microprocessor storing a plurality of audio output in digital form and being programmed to generate said audio output upon activation of one of said at least one second switch and said third switch;

a base supporting said activity unit interchangeably between a first orientation and a second orientation; and a housing formed on one of said activity unit and said base, said housing defining a first and second engagement with a mating piece formed on the other of said base and said activity unit, wherein when said mating piece is engaged with said first engagement, said activity unit is in said first orientation such that said substantially planar surface extends approximately parallel to the support surface, and wherein when said mating piece is engaged with said second engagement, said activity unit is in said second orientation, said second orientation being rotatably offset from said first orientation;

wherein when said convertible child's toy is in the first configuration, said activity unit is in said first orientation, said at least one second switch is enabled and said third switch is disabled;

wherein when said convertible child's toy is in the second configuration, said activity unit is in said second orientation and said third switch is enabled.

2. The convertible child's toy of claim 1, said convertible toy including an actuator portion for actuation of said third switch when said convertible toy is in said second configuration.

3. The convertible toy of claim 2, wherein said actuator portion is associated with said support and said support includes an elongate planar piece having a first connector for suspending said at least one dangling toy therefrom and a second connector pivotally coupling said elongate planar piece to said activity unit housing.

4. The convertible toy of claim 3, wherein said second connector includes an extension disposed in operative proximity to a first metal contact when said third switch is enabled, said extension including a sloped surface adapted for displacing said first metal contact when said elongate planar piece is pivoted about said housing.

5. The convertible toy of claim 1, wherein when said convertible child's toy is in the second configuration, said at least one second switch is enabled.

6. The convertible toy of claim 1, wherein when said activity unit is in the second orientation, said substantially planar surface extends approximately perpendicular to the support surface.

7. A method for entertaining an infant and a toddler by providing a musical toy that is convertible between a first orientation suitable for use by the toddler and a second orientation suitable for use by the infant, the infant referring to a child who has not fully developed such that he or she is capable of standing and the toddler referring to a child who is capable of standing, the musical toy being disposable on a support surface, said method for entertaining an infant and a toddler comprising the steps of:

providing an activity unit including a housing defining a substantially planar surface and a sensory output device, the sensory output device including at least one first switch adapted for producing audio output upon activation by the toddler, and a second switch adapted for producing audio output upon activation by the infant interacting with at least one dangling toy;

a microprocessor associated with the at least one first switch and the second switch, the microprocessor storing a plurality of audio output in digital form and being programmed to generate the audio output upon activation of one of the at least one first switch and the second switch;

providing a base supporting the activity unit interchangeably between a first orientation and a second orientation;

providing a housing formed on one of the activity unit and the base, the housing defining a first and second engagement structure for receiving a mating piece formed on the other of the base and said activity unit, wherein when the mating piece is engaged with the first engagement structure, the activity unit is in a first orientation such that the substantially planar surface extends approximately parallel to the support surface, and wherein when the mating piece is engaged with the second engagement structure, the activity unit is in a second orientation, the second orientation being rotatably offset from the first orientation;

wherein when it is desirable to entertain the toddler, configuring the convertible toy in the first orientation so as to allow a toddler standing beside the activity unit to access the at least one first switch, and enabling the at least one first switch and disabling the second switch; and wherein when it is desirable to entertain the infant, configuring the convertible toy in the second orientation so as to allow an infant disposed beneath the activity unit to access the second switch by interaction with the at least one dangling toy, and enabling the second switch.

8. The method of claim 7, said configuring the convertible toy in the second orientation so as to allow an infant disposed beneath the activity unit to access the second switch by interaction with the at least one dangling toy further comprising the step of securing a plurality of dangling toys to an elongate support, the elongate support being pivotally coupled to the housing.

9. The method of claim 8, wherein said enabling the second switch step includes positioning the elongate support from a stowed position to a deployed position.

10. The method of claim 7, wherein said configuring the convertible toy in the first orientation so as to allow a toddler standing beside the activity unit to access the at least one first switch further comprises the step of removing the at least one dangling toy from the housing.

11. The method of claim 7, wherein said configuring the convertible toy in the second orientation so as to allow an infant disposed beneath the activity unit to access the second switch by interaction with the at least one dangling toy further comprising the step of positioning the substantially planar surface such that the substantially planar surface extends approximately perpendicular to the support surface so as to allow the infant disposed in a prone position and beneath the activity unit to displace the at least one dangling toy by one of the infant's hands and feet.

12. The method of claim 7, wherein said providing an activity unit further comprises providing a third switch including an "on" and "off" position, wherein said enabling the at least one first switch step includes positioning the third switch from the "off" to "on" position.

13. A convertible toy for use by a toddler and an infant, said convertible toy having a first and second configuration and being supportable on a support surface, comprising:

an activity unit including a housing defining a substantially planar surface, and a sensory output device, said sensory output device including a first switch for selecting between an "on" and "off", at least one second switch for producing audio output by the toddler, means for producing audio output by the infant, and a microprocessor associated with said first switch, said at least one second switch and said means for producing audio output by the infant, said microprocessor storing a plurality of audio output in digital form and being programmed to generate said audio output upon activation of one of said at least one first switch and said means for producing audio output by the infant;

a base supporting said activity unit interchangeably between a first orientation and a second orientation; and a housing formed on one of said activity unit and said base, said housing defining a first and second engagement with a mating piece formed on the other of said base and said activity unit, wherein when said mating piece is engaged with said first engagement, said activity unit is in said first orientation such that said substantially planar surface extends approximately parallel to the support surface, and wherein when said mating piece is engaged with said second engagement, said activity unit is in said second orientation, said second orientation being rotatably offset from said first orientation;

wherein when said convertible child's toy is in the first configuration, said activity unit is in said first orientation, said at least one second switch is enabled and said means for producing audio output by the infant is disabled;

wherein when said convertible child's toy is in the second configuration, said activity unit is in said second orientation and said means for producing audio output by the infant is enabled.

14. The convertible toy of claim 13, wherein said means for producing audio output by the infant includes an elongate support pivotally coupled to said housing, said elongate support being adapted for receiving a plurality of dangling toys.

15. The convertible toy of claim 14, wherein said elongate support is a rocker bar.

16. The convertible toy of claim 14, wherein said elongate support includes a plurality of toy connectors and a first and second pivot, said plurality of toy connectors being adapted for pivotally and releasably receiving said plurality of dangling toys and said first and second pivot pivotally couples said elongate support to said housing.

17. The convertible toy of claim 16, wherein said means for producing audio output by the infant is enabled corresponds to said elongate support being configured in a first, deployed position and said means for producing audio output by the infant is disabled corresponds to said elongate support being configured in a second, stowed position.

* * * * *